US006511106B2

(12) United States Patent
Perkins et al.

(10) Patent No.: US 6,511,106 B2
(45) Date of Patent: Jan. 28, 2003

(54) VEHICLE DOOR LATCH WITH DOUBLE LOCK

(75) Inventors: Donald Michael Perkins, Troy, MI (US); Frank Joseph Arabia, Jr., Macomb, MI (US); Maxwell Walter Hamilton, Warren, MI (US)

(73) Assignee: Delphi Technologies, Inc., Troy, MI (US)

( * ) Notice: Subject to any disclaimer, the term of this patent is extended or adjusted under 35 U.S.C. 154(b) by 97 days.

(21) Appl. No.: 09/737,171

(22) Filed: Dec. 14, 2000

(65) Prior Publication Data

US 2002/0074806 A1 Jun. 20, 2002

(51) Int. Cl.[7] ..... E05C 3/06
(52) U.S. Cl. ..... 292/216; 292/DIG. 23
(58) Field of Search ..... 292/216, 201, 292/DIG. 23; 70/264, 279.1, 280, 282

(56) References Cited

U.S. PATENT DOCUMENTS

| | | | | |
|---|---|---|---|---|
| 4,093,289 A | | 6/1978 | Inabayashi et al. | |
| 4,364,249 A | | 12/1982 | Kleefeldt | |
| 4,736,829 A | | 4/1988 | Noel | |
| 4,779,912 A | | 10/1988 | Ikeda et al. | |
| 4,966,266 A | | 10/1990 | Yamada et al. | |
| 5,277,461 A | | 1/1994 | Dzurko et al. | |
| 5,328,219 A | | 7/1994 | Konchan et al. | |
| 5,474,338 A | * | 12/1995 | Buscher | 292/201 |
| 5,603,537 A | | 2/1997 | Amano et al. | |
| 5,634,677 A | | 6/1997 | Buscher et al. | |
| 5,680,783 A | | 10/1997 | Kuroda | |
| 5,803,515 A | | 9/1998 | Arabia, Jr. et al. | |
| 5,833,282 A | | 11/1998 | Ikeda | |
| 5,855,130 A | | 1/1999 | Rorabacher et al. | |
| 5,899,508 A | | 5/1999 | Cetnar et al. | |
| 5,992,194 A | | 11/1999 | Baukholt | |
| 6,019,402 A | * | 2/2000 | Arabia | 292/216 |
| 6,045,168 A | * | 4/2000 | Johnson | 292/216 |
| 6,053,543 A | * | 4/2000 | Arabia | 292/201 |

FOREIGN PATENT DOCUMENTS

| | | |
|---|---|---|
| DE | 2911681 A1 | 10/1980 |
| DE | 19611972 A1 | 10/1996 |
| EP | 0645511 A1 | 9/1994 |
| EP | 0834631 A1 | 9/1996 |
| GB | 2054725 | 6/1979 |

* cited by examiner

*Primary Examiner*—Gary Estremsky
(74) *Attorney, Agent, or Firm*—Kathryn A. Marra

(57) ABSTRACT

A vehicle door latch has a forkbolt, a detent that holds the forkbolt in a latched position, a release mechanism that moves the detent to release the forkbolt and a lock mechanism for disabling the release mechanism. The detent is moved by an intermittent lever that is part of the release mechanism and part of the locking mechanism. A lock lever forming part of the lock mechanism moves the intermittent lever back and forth between an unlock position where the intermittent lever drives the detent to release the forkbolt and a lock position where the intermittent lever free wheels with respect to the detent. The intermittent lever is pivotally connected to an unlatching lever of the release mechanism that is operated by inside and outside release levers. The lock lever includes a lower lock lever, an upper lock lever and a spring that stores energy when the lower lock lever pivots with respect to the upper lock lever. The lock mechanism includes an inside lock lever and an outside lock lever for operating the lower lock lever. The door latch also includes a motor driven actuator assembly for operating the lock mechanism, a motor driven double lock assembly for disabling the lock assembly so that the door latch cannot be unlocked by the inside lock lever, and a mechanical override lever for operating the double lock assembly in the event of power failure.

8 Claims, 12 Drawing Sheets

VEHICLE DOOR LATCH WITH DOUBLE LOCK

This invention relates generally to a vehicle door latch and more particularly to a vehicle door latch that has a forkbolt, a detent for holding the forkbolt in a latched position, a release mechanism for moving the detent to a position releasing the forkbolt, a power operated lock mechanism for disabling the release mechanism, an inside operator for operating the lock mechanism and a double lock for disabling the inside operator.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well known manner to latch the door when it is closed and to lock the door in the closed position or to unlock and unlatch the door so that the door can be opened manually.

The door latch is operated remotely from the exterior of the automobile by two distinct operators—typically a key cylinder that controls the lock mechanism and an outside door handle or push button that controls the release mechanism.

The door latch is also operated remotely from inside the passenger compartment by two distinct operators—a sill button that controls the lock mechanism and an inside door handle that controls the release mechanism. Vehicle door latches for upscale automobiles also include power door locks in which the lock mechanism is motor driven and/or a keyless entry in which a key fob transmitter sends a signal to a receiver in the vehicle to operate a motor driven lock mechanism.

Another feature that is gaining popularity is the double lock. The purpose of the lock mechanism of course is to prevent unauthorized entry into the vehicle by locking the vehicle doors. However, unauthorized persons can enter locked vehicles by gaining access to the sill button or other inside operator that controls the lock mechanism of the door latch. The double lock disables the inside operator thus preventing unauthorized entry into the vehicle by gaining access to the inside operator.

U.S. Pat. No. 5,277,461 granted to Thomas A. Dzurko et al Jan. 11, 1997 for a vehicle door latch, which is hereby incorporated in this patent specification by reference, discloses a typical door latch of the above noted type. The door latch disclosed in the Dzurko '461 patent includes an unlatching lever that is pivotally mounted on a stud that is secured to a metal back plate and a metal face plate at opposite ends. Unlatching lever is operated to unlatch the vehicle door by an inside handle lever that is connected by a suitable linkage for rotation by an inside door handle (not shown). Unlatching lever is also operated by an outside handle lever that is connected by suitable linkage for rotation by an outside door handle (not shown).

The Dzurko door latch also includes a locking lever that is pivotally mounted on the stud. Locking lever is operated by an inside locking lever that is pivotally mounted on the flange of the metal face plate near the inside handle lever. The inside locking lever is operated by an inside sill button or lock slide through a suitable linkage (not shown). Locking lever is also operated by an outside locking lever that is operated by a key lock cylinder through a suitable linkage (not shown). In some instances, for example in upscale automobiles, locking lever is also power operated by a remotely controlled linear electric motor or the like in a well known manner (not shown).

The door latch disclosed in the Dzurko '461 patent is unlocked and unlatched in the following sequence. First the locking lever is moved to the unlocked position by the inside locking lever, the outside locking lever, or in the instance of a vehicle equipped with power door locks, a remotely controlled motor. This moves the intermittent lever to the unlocked position. After the door latch is unlocked, the door latch is unlatched by moving the unlatching lever via inside handle lever or outside handle lever to the unlatched position pulling intermittent lever and detent down to unlatch the door lock. The vehicle door then may be pushed or pulled open manually.

U.S. Pat. No. 5,328,219 granted to Jeffrey L. Kochan et al Jul. 12, 1994 shows vehicle closure latch of the same general type. U.S. Pat. Nos. 6,019,402 and 6,053,543 granted to Frank J. Arabia et al Feb. 1, 2000 and Mar. 25, 2000 respectively also show a vehicle closure latch of the same general type. The vehicle closure latch disclosed in these latter patents include an optional power actuator assembly and an optional double lock assembly.

SUMMARY OF THE INVENTION

The object of this invention is to provide a vehicle door latch that is compact, durable and versatile while providing room for the efficient packaging of a power actuator assembly and a double lock assembly should either or both of these options be desired.

Another object of the invention is to provide a vehicle door latch that has a double lock assembly that is compact.

A feature of the vehicle door latch of the invention is that the vehicle door latch has a housing that includes chambers for the efficient packaging of a power actuator assembly and a double lock actuator assembly in a unique way to reduce space requirements, particularly height requirements.

Another feature of the vehicle door latch of the invention is that the vehicle door latch has a double lock assembly that rotates back and forth between a by-pass position and a block-out position where the inside operator is disabled.

Yet another feature of the vehicle door latch of the invention is that the vehicle door latch has a double lock assembly that has a power operated rotary cam drive that drives a separate double lock block-out to a block-out position to disable the inside operator.

Still another feature of the vehicle door latch of the invention is that the double lock assembly has an optional mechanical override lever that returns the double lock block-out to the by-pass position in the event of power failure.

These and other objects, features and advantages of the invention will become apparent from the description below, which is given by way of example with reference to the accompanying drawings.

DESCRIPTION OF THE PREFERRED EMBODIMENT

Figure 1:
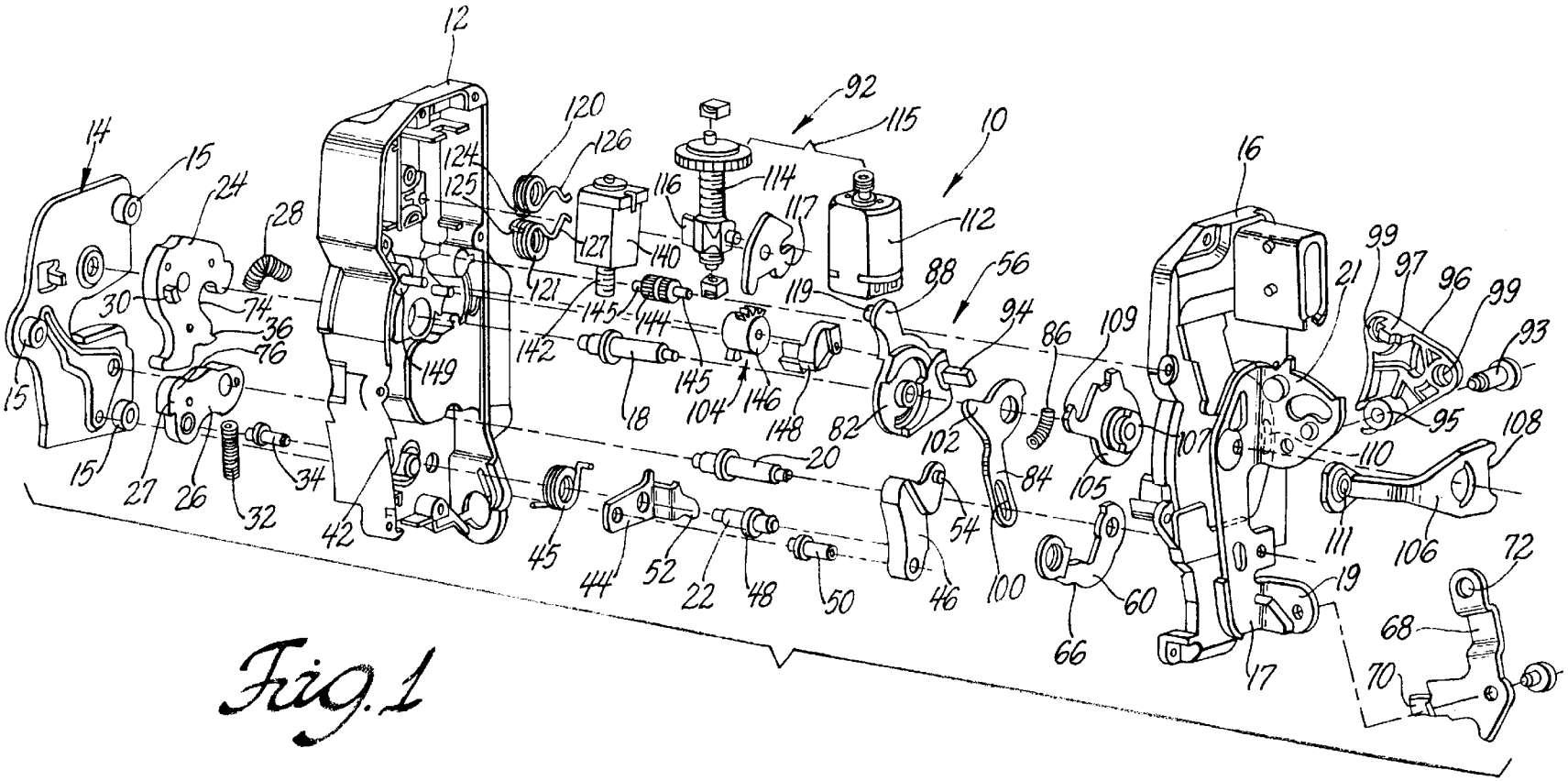
FIG. 1 is an exploded perspective front view of a vehicle door latch of the invention for the front passenger door of the vehicle.

Referring now to FIG. 1, the vehicle door latch 10 has a multi-piece enclosure that comprises plastic housing 12, metal frame or face plate 14, a plastic front cover 16 and a front plate 17. The plastic housing 12 and the metal face plate 14 are held together by three flanged studs 18, 20 and 22 that are inserted through three holes in plastic housing 12, then through three aligned holes in the metal face plate 14 and then flanged over the metal face plate 14 to form a rearward compartment. Metal face plate 14 has three flanged and threaded holes 15 substantially equally spaced from each other defining an imaginary substantially equilateral triangle (not shown) for attaching the vehicle door latch 10 to a vehicle door (not shown).

Figure 2:
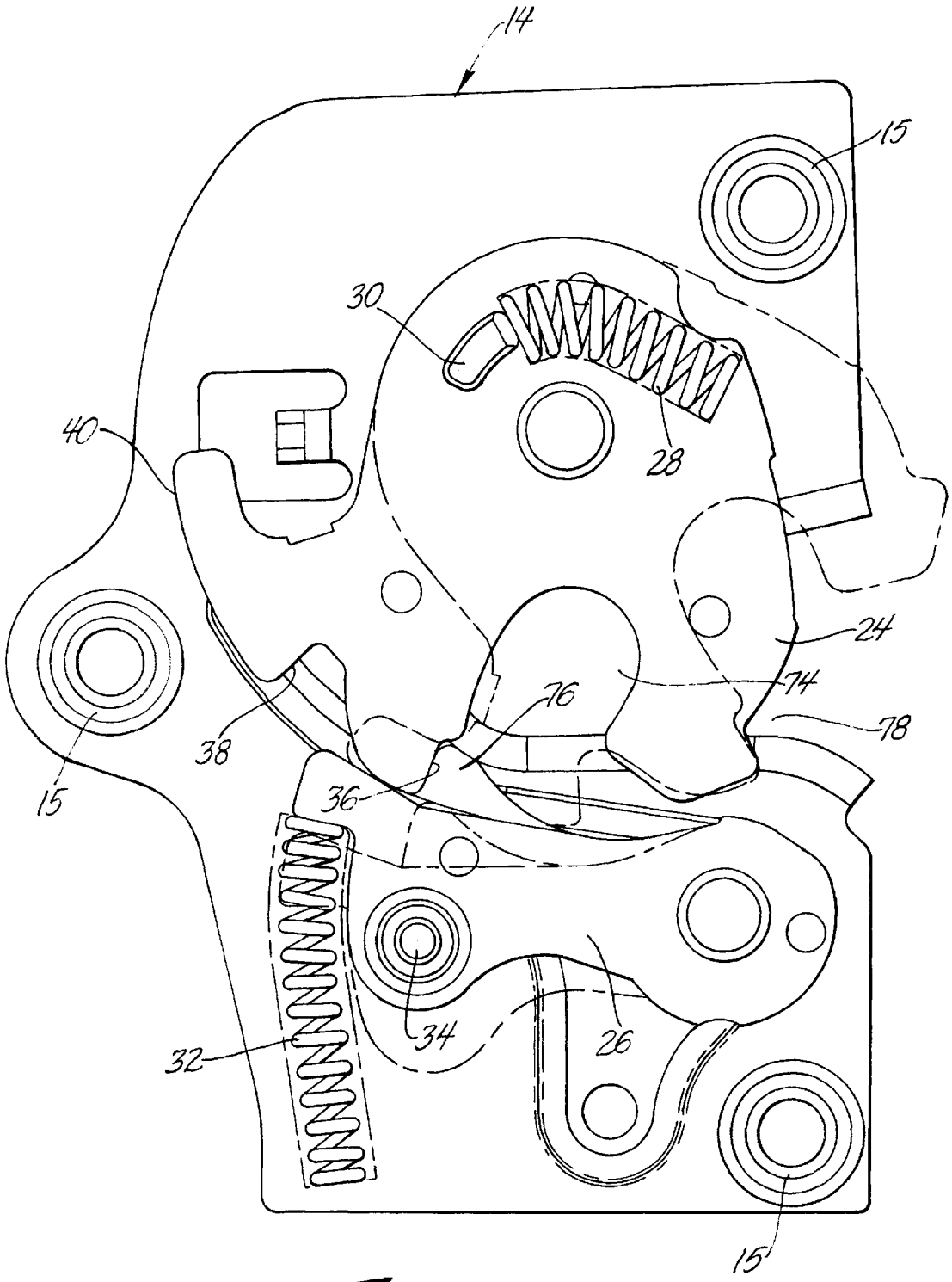
FIG. 2 is a front view of the latch mechanism of the vehicle door latch of FIG. 1 showing various parts of the latch mechanism in position in solid line when the door latch is latched and unlocked and in dashed line when the door latch is unlatched and unlocked.

Door latch 10 has a latch mechanism comprising a forkbolt 24 and a cooperating detent 26 that are located in the rearward compartment and pivotally mounted on the rearward portions of studs 18 and 20 respectively as best shown in FIG. 2. Forkbolt 24 is biased counterclockwise by a compression return spring 28 that is disposed in a curved slot in partition wall 13 of plastic housing 12 in front of forkbolt 24. Spring 28 engages a lateral lug 30 of forkbolt 24 at one end and an end wall of the curved slot at the other end. Detent 26 is biased clockwise into engagement with forkbolt 24 by a compression spring 32 that engages an ear 27 of detent 26 at one end. The opposite end of compression spring 32 engages an internal wall of plastic housing 12.

Detent 26 engages forkbolt 24 at shoulder 36 and holds forkbolt 24 in a primary latched position against the bias of compression spring 28 as shown in solid line in FIG. 2. Detent 26 can also engage forkbolt 24 at shoulder 38 and hold it in an intermediate secondary latched position. Detent 26 engages forkbolt 24 at foot 40 in its unlatched or release position as shown in dashed line in FIG. 2.

Detent 32 has a perpendicular pin 34 that extends through a slot 42 of partition wall 13 into a forward compartment formed by plastic housing 12 and plastic front cover 16. Front cover 16 is attached to housing 12 by five screws (not shown) at five locations 43 along the periphery of front cover 16.

Figure 3:
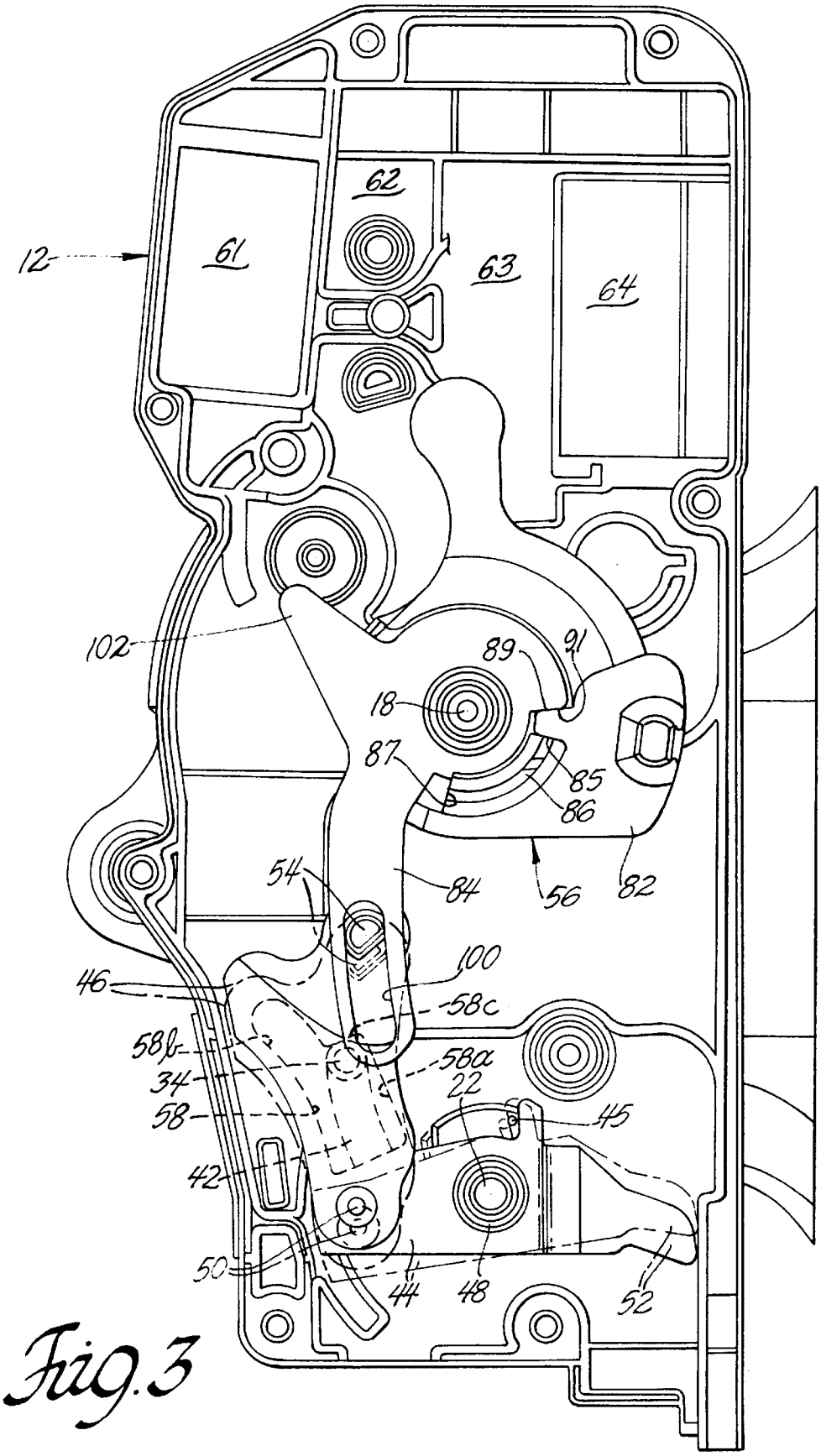
FIG. 3 is a front view of the plastic housing of vehicle door latch of FIG. 1 showing parts of the release mechanism and the lock mechanism in position in solid line when the door latch is latched and unlocked and in dashed line when the door latch is unlatched and unlocked.
Figure 4:
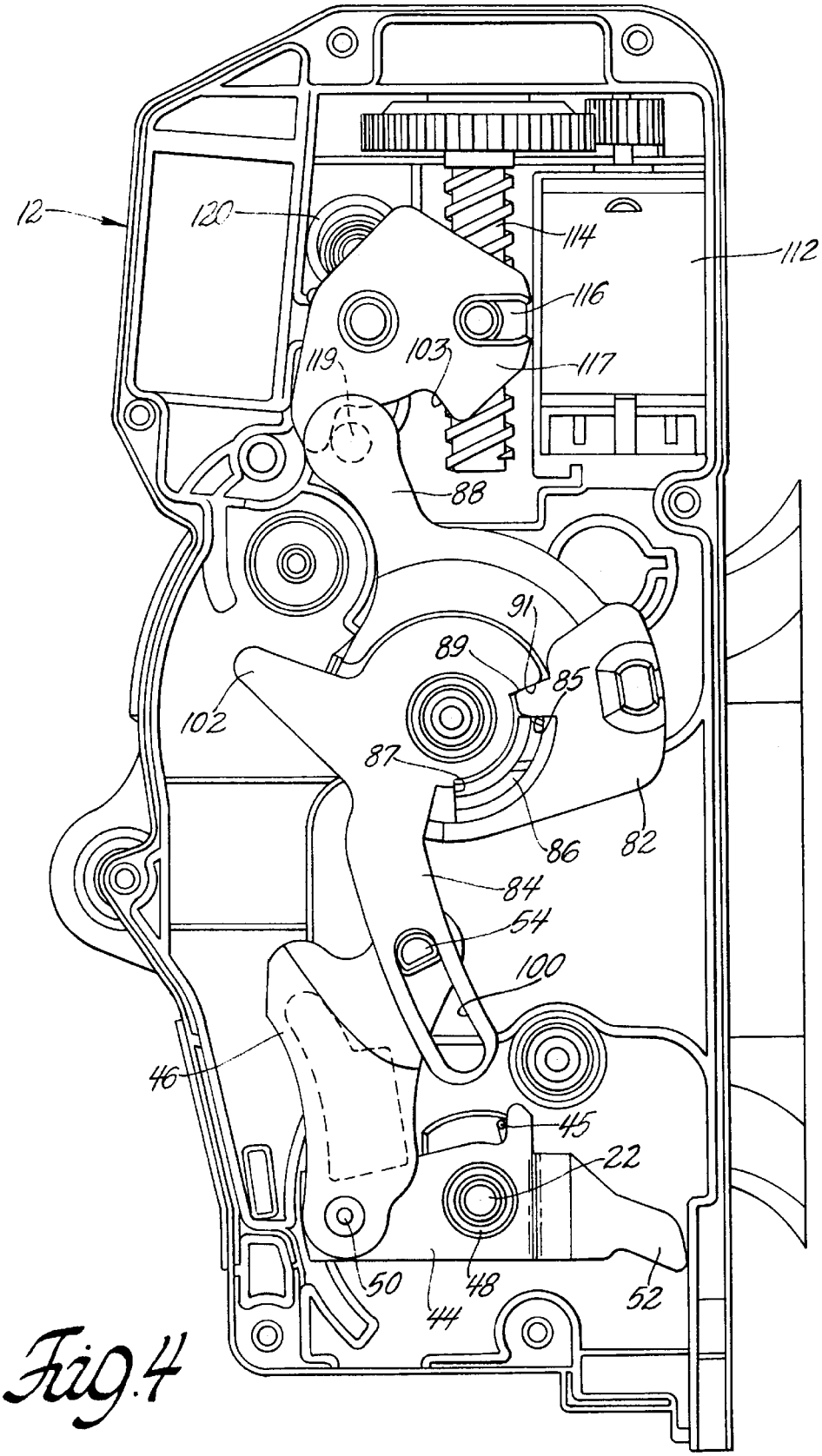
FIG. 4 is a front view of the plastic housing of the vehicle door latch of FIG. 1 showing parts of the release mechanism and the lock mechanism in position when the door latch is latched and locked.

Door latch 10 has a release mechanism for releasing or unlatching the latching mechanism that is best shown in FIGS. 1, 3 and 4. The release mechanism comprises an unlatching lever 44 and an intermittent lever 46 for operating detent 26 that are located in the forward compartment that is formed by plastic housing 12 and front cover 16. Unlatching lever 44 is pivotally mounted on stud 22 and held in place by flange 48. A torsion return spring 45 surrounds stud 22 between unlatching lever 44 and housing 12. One end of torsion return spring 45 is anchored to housing 12 and the other end engages unlatching lever 44 so that unlatching lever 44 is biased clockwise to a generally horizontal latching position as viewed in FIGS. 1, 3 and 4. Front cover 16 and several parts including outside release lever 60, double lock back drive lever 105 and key cylinder lever 106 described below are removed in FIGS. 3 and 4 to facilitate illustration of internal components in the forward compartment.

The lower end of intermittent lever 46 is pivotally attached to one end of unlatching lever 44 by intermittent lever pin 50. Pin 50 has a rearward pivot portion and a forward drive portion that projects forwardly of intermittent lever 46. The opposite end of unlatching lever 44 is bent to provide a spaced generally parallel tab 52 that is used for operating unlatching lever 44. The upper end of intermittent lever 46 has a drive pin 54 that is disposed in a slot of a composite lock lever 56. Intermittent lever 46 has a forward facing groove 58 located between pins 50 and 54 that receives the end of detent pin 34 that projects through housing slot 42. Detent pin 34 engages a drive shoulder **58*c* at the upper end of a short drive portion 58*a* of groove 58 when door latch 10 is unlocked as shown in FIG. 3**.

Briefly the composite lock lever 56 which is pivotally mounted on the forward portion of stud 18 is rotated clockwise to unlock the door latch 10 or counterclockwise to lock door latch 10. Counterclockwise rotation pivots intermittent lever 46 clockwise about lever pin 50 from an unlocked position shown in FIG. 3 to a locked position shown in FIG. 4 where pin 34 of detent 26 is located in a lost motion portion **58*b* of groove 58 so that intermittent lever 46 does not drive detent 26 when it is pulled down. A more complete description of composite lock lever 56** and the lock mechanism is given after the release mechanism is described.

When the lock mechanism is disengaged as shown in FIG. 3, detent 26 rotates counterclockwise from the latched position shown in FIG. 1 and in solid line in FIG. 2 and out of latched engagement with the forkbolt 24 to a release or unlatched position shown in dashed line in FIG. 2 when the intermittent lever 46 is pulled down. This releases forkbolt 24 so that it is free to rotate counterclockwise from the latched position shown in solid line in FIG. 2 to the unlatched position shown in dashed line under the bias of compression return spring 28 when the vehicle door is opened.

The release mechanism further comprises an outside release lever 60. One end of outside release lever 60 is pivotally mounted on stud 20 adjacent is front cover 16 and metal plate 17. Metal plate 17 is attached by the forward portions of studs 18 and 20. The opposite end of outside release lever 60 projects out of the forward compartment formed by housing 12 and front cover 16 for connection to an outside door handle or the like via a suitable linkage (not shown). The middle portion of outside release lever 60 and a lower edge 66 that engages the forward drive portion of intermittent lever pin 50 so that outside release lever 60 pushes intermittent lever 46 down when outside release lever 60 is rotated counterclockwise as viewed in FIGS. 1, 3 and 4.

The release mechanism further comprises an inside release lever 68 that is L-shaped. The middle of inside release lever 68 is pivotally mounted on a lower flange 19 of metal plate 17 by a stud. Inside release lever 68 has a drive tab 70 at the lower end that extends through a slot of front cover 16 and engages ear 52 of unlatching lever 44 so that inside release lever 68 rotates unlatching lever 44 counterclockwise when it is rotated clockwise as viewed in FIGS. 1, 3 and 4. The upper end of inside release lever 68 has a hole 72 by which lever 68 is connected by suitable linkage for rotation by an inside door handle or other operator (not shown).

Forkbolt 24 has a conventional slot or throat 74 for receiving and retaining a strike member of a conventional striker assembly that is attached to a vehicle door pillar (not shown) to latch the vehicle door in the closed position as shown in solid line in FIG. 2. Forkbolt 24 also includes a primary latch shoulder 36; an intermediate secondary latch shoulder 38 and a radially projecting foot 40 as indicated above. Forkbolt 24 preferably has a plastic coating that covers a surface of the slot 74 that is engaged by the strike member for energy absorption and quiet operation when the vehicle door is slammed shut.

Detent 26 has a sector shaped catch 76 that engages the radially projecting foot 40 when the forkbolt 24 is in the unlatched position shown in dashed lines in FIG. 2. The sector shaped catch 76 positively engages the primary and secondary latch shoulders 36 and 38 to hold the forkbolt 24 in either the primary latched position (FIGS. 1 and 2) or the intermediate secondary latched position (not shown).

The latch mechanism described above operates as follows. When the door latch 10 is in an unlatched and unlocked condition, forkbolt 24 is poised to receive the strike member of a strike assembly as shown in dashed lines in FIG. 2. The strike member projects into an aligned fish mouth slot 78 of metal face plate 14 and an aligned mouth slot of housing 12 when the door is shut. The entering strike member engages the back of throat 74 and rotates forkbolt 24 clockwise against the bias of compression spring 28 until forkbolt 24 is rotated to the primary latch position shown in solid line in FIG. 2 where forkbolt 24 captures the strike member in throat 74. Forkbolt 24 is held in the primary latch position by catch 76 of detent 26 engaging primary latch shoulder 36 of forkbolt 24.

Catch 76 rides along the periphery of the forkbolt 24 under the bias of compression spring 32 as forkbolt 24 rotates clockwise from the unlatched position to the primary latch position shown in FIG. 2 in dashed and solid line respectively. During this travel, catch 76 rides under the foot 40 into engagement with the intermediate secondary latch shoulder 38 and then into engagement with the primary latch shoulder 36. The engagement of catch 76 with the intermediate secondary latching shoulder 38 is sufficient to hold the vehicle door closed in the event that the vehicle door is not shut with sufficient force so that catch 76 engages primary latch shoulder 36.

The vehicle door latch 10 is now latched but not locked. Consequently the vehicle door can be opened simply by operating either an inside or outside door handle or the like to rotate inside release lever 68 or outside release lever 60 to pull intermittent lever 46 down either directly or by rotating the unlatching lever 44 counterclockwise as viewed in FIGS. 1 and 3. FIG. 3 shows outside latching lever 44 rotated counterclockwise to the unlatch position shown in dashed line. This pulls pin 50 and intermittent lever 46 down. As the intermittent lever 46 is pulled down, drive shoulder 58*c* pulls detent pin 34 down and rotates detent 26 counterclockwise against the bias of compression spring 32 from the primary latch position shown in solid line in FIG. 2 to the release or unlatch position shown in dashed lines in FIG. 2. Forkbolt 24 is then free to rotate counterclockwise under the bias of compression spring 28 from the primary latch position shown in FIG. 1 and in solid line in FIG. 2 to an unlatched position shown in dashed line as the strike member is pulled out of throat 74 and the aligned fishmouth slots of housing 12 and plate 14 when the vehicle door is opened.

Door Latch 10 has a lock mechanism for disabling the release mechanism that is also located in the forward compartment defined by plastic housing 12 and front cover 16. The lock mechanism includes the composite lock lever 56 which as indicated above, rotates intermittent lever 46 clockwise to a locked decoupled position with respect to detent pin 34 as shown in FIG. 4.

Composite lock lever 56 comprises a lower lock lever 82, an upper lock lever 84 and a compression spring 86 as shown in FIGS. 1, 3 and 4.

Lower lock lever 82 is pivotally mounted on stud 18 ahead of upper lock lever 84. Lower lock lever 82 has a radial arm 88 that cooperates with power lock assembly 92 for rotating the lower lock lever between locked and unlocked positions. Lower lock lever 82 also has a drive tab 94 (FIG. 1) that projects through a slot 110 of front cover 16. The projecting end is engaged by inside lock lever 96 for rotating lower lock lever 82 between the locked and unlocked positions manually.

The inside lock lever 96 is pivotally mounted on an upper flange 21 of metal plate 17 by a stud 93 as best shown in FIG. 1. A socket 95 adjacent the pivot hole for inside lock lever 92 receives the end of drive tab 94 so that inside lock lever 96 rotates lower lock lever 82 counterclockwise when it rotates clockwise and vice-versa. A laterally projecting tab 97 (FIG. 1) of inside lock lever 96 cooperates with a slot in upper flange 21 to locate the engaged and disengaged positions of inside lock lever 96 at opposite ends of the flange slot. An overcenter spring (not shown) has one end attached to upper flange 21 and the opposite end attached to the inside lock lever 96 so that inside lock lever 96 is biased against one end or the other of the flange slot. Stated another way, inside lock lever 96 is biased to either an engaged or a disengaged position by the overcenter spring.

The inside lock lever 96 has two spaced holes at 99 opposite socket 95. One or other of the holes is used for attaching inside lock lever 96 to an operator inside a vehicle, such as a sill button, via a suitable linkage (not shown). The hole that is used depends on the application of door latch 10.

Upper lock lever 84 is pivotally mounted on stud 18 on top of lower lock lever 82 as shown in FIGS. 3 and 4.

Compression spring 86 is disposed between lower and upper lock levers 82 and 84 and contained in a curved slot formed by portions of lower lock lever 82 and upper lock lever 84. One end of compression spring 86 engages a stop 85 of lower lock lever 82 and the other end of spring 86 engages a stop 87 of upper lock lever 84 so that upper lock lever 84 is biased clockwise with respect to lower lock lever 82 as best shown in FIGS. 3 and 4.

Upper lock lever 84 has a slot 100 at the lower end and an ear 102 at the upper end. Slot 100 receives drive pin 54 of intermittent lever 46. Ear 102 cooperates with an optional double lock assembly 104 as explained below.

A double lock back drive lever 105 is pivotally mounted on stud 18 on top of upper lock lever 84 as shown in FIG. 1. Lever 105 has a hub 107 that projects through a hole in plastic cover plate 16. The exterior key lock cylinder lever 106 is non-rotationally attached to hub 107 between front cover 16 and metal plate 17. Lever 105 has been omitted in FIGS. 3 and 4 for clarity. Key cylinder lever 106 has a drive slot 108 at one end that receives the end of drive tab 94 of lower lock lever 82 that projects through slot 110 of cover 16 so that lower lock lever 82 can be rotated by the exterior key cylinder lever 106 also. Drive slot 108 is wider than drive tab 94 to permit independent operation of lower lock lever 82 by inside lock lever 96 or power lock assembly 92. Lever 105 has a radial ear 109 and an optional slot that cooperate with the optional double lock assembly 104 and an optional signal switch (not shown) respectively as explained below. The outer end of key cylinder lever 106 has a hole 111 for attaching the key cylinder lever to a key lock cylinder or the like by a suitable linkage (not shown). Key cylinder lever 106 is used in any application having a key lock cylinder or the like, such as front doors of vehicles. However, key cylinder lever 106 may be omitted in any application that does not have a key lock cylinder or other operator for unlocking a vehicle door from the exterior, such as rear doors of passenger vehicles.

Door latch 10 is locked in the following manner. Lower lock lever 82 is rotated counterclockwise from the unlocked position shown in FIGS. 1 and 3 to the locked position shown in FIG. 4 by rotating either key cylinder lever 106 counterclockwise or inside lock lever 96 clockwise. Lower lock lever 82 drives is upper lock lever 84 counterclockwise to the locked position via abutting portions 89 and 91. As upper lock lever 84 rotates counterclockwise, slot 100 which engages drive pin 54 rotates intermittent lever 46 clockwise from the unlocked position shown in FIG. 3 to a locked position shown in FIG. 4 where drive pin 34 of detent 26 is located in a lost motion portion 58b of groove 58. Consequently when intermittent lever 46 is pulled down by unlatching lever 44 or outside release lever 60 in an unlatching operation, motion is not transferred to detent pin 34. Detent 34, therefore, stays engaged with forkbolt 24 and the door latch 10 remains latched.

Door latch 10 is unlocked by rotating the lower lock lever 82 clockwise back to the unlocked position shown in FIG. 3. Lower lock lever 82 rotates upper lock lever 84 clockwise more or less simultaneously back to the unlocked position shown in FIG. 3 via compression spring 86. As upper lock lever 84 rotates clockwise, slot 100 drives intermittent lever 46 counterclockwise back to the unlocked position via pin 54.

Composite lock lever 56 may be replaced by a simpler lock lever of unitary construction (not shown) in a basic vehicle door latch. However, the composite lock lever 56 is preferred because the composite lock lever 56 provides an anti-jamming feature that allows premature actuation of inside release lever 68 or outside release lever 60 and a subsequent unlocking operation while either inside release lever 68 or outside release lever 60 is held in a release or unlatching position.

This anti-jamming feature operates as follows. When door latch 10 is locked as shown in dashed line in FIG. 4, detent pin 34 is positioned in the elongated portion 58*b* of intermittent lever groove 58. When door latch 10 is locked and either inside release lever 68 or outside release lever 60 is actuated, intermittent lever 46 is pulled down so that detent pin 34 is repositioned in the upper portion of elongated last motion portion 58*b* of slot 58 above drive shoulder 58*c*. If a one-piece lock lever is used in place of composite lock lever 56, the one-piece lock lever cannot be pivoted clockwise back to the unlocked position if either release lever 60 or 68 is actuated and held in an unlatching or release position because intermittent lever 46 is held against rotation by detent pin 34 and cannot pivot counterclockwise. However, when composite lock lever 56 is used, only upper lock lever 84 is held against rotation by detent pin 34. Thus, an unlocking operation of inside lock lever 96 or key cylinder lever 106 still rotates lower lock lever 82 clockwise back to the unlocked position shown in solid line in FIG. 4. This loads lock lever spring 86 and "cocks" composite lock lever 56 so that upper lock lever 84 pivots clockwise to the unlocked position shown in solid line in FIG. 4 under the action of lock lever spring 86 when the prematurely actuated release lever 60 or 68 is returned to the latch position allowing unlatching lever 44 and coiled spring 45 to raise intermittent lever 46. When intermittent lever 46 rises up, detent pin 34 is free to enter the short drive portion 58*a* of slot 58 below drive shoulder 58*c*. Hence intermittent lever 46 is simultaneously pivoted counterclockwise to the unlocked position shown in solid line in FIG. 4 under the action of lock lever spring 86 due to the presence of drive pin 54 in slot 100.

Door latch 10 is now unlocked and can now be unlatched by a second unlatching operation by either inside release lever 68 or outside release lever 60.

The anti-jamming feature provided by composite lock lever 56 is particularly advantageous when a power lock assembly, such as the power lock assembly 92 described below is used because jamming is more likely to occur in a power unlocking operation rather than in a manual unlocking operation.

The composite lock lever 56 is also preferred because the optional double lock feature described below can be provided easily without any need for changing the lock lever.

Door latch 10 in general and plastic housing 12 in particular are designed for including a power lock assembly and/or a double lock assembly in an efficient and compact manner. More particularly plastic housing 12 has four side-by-side chambers 61, 62, 63 and 64 near its upper end as best shown in FIG. 3.

Outer chambers 61 and 64 are elongated vertically and sized to receive electric motors while inner chambers 62 and 63 are designed to receive parts of the power lock assembly 92 as explained below.

Figure 5:
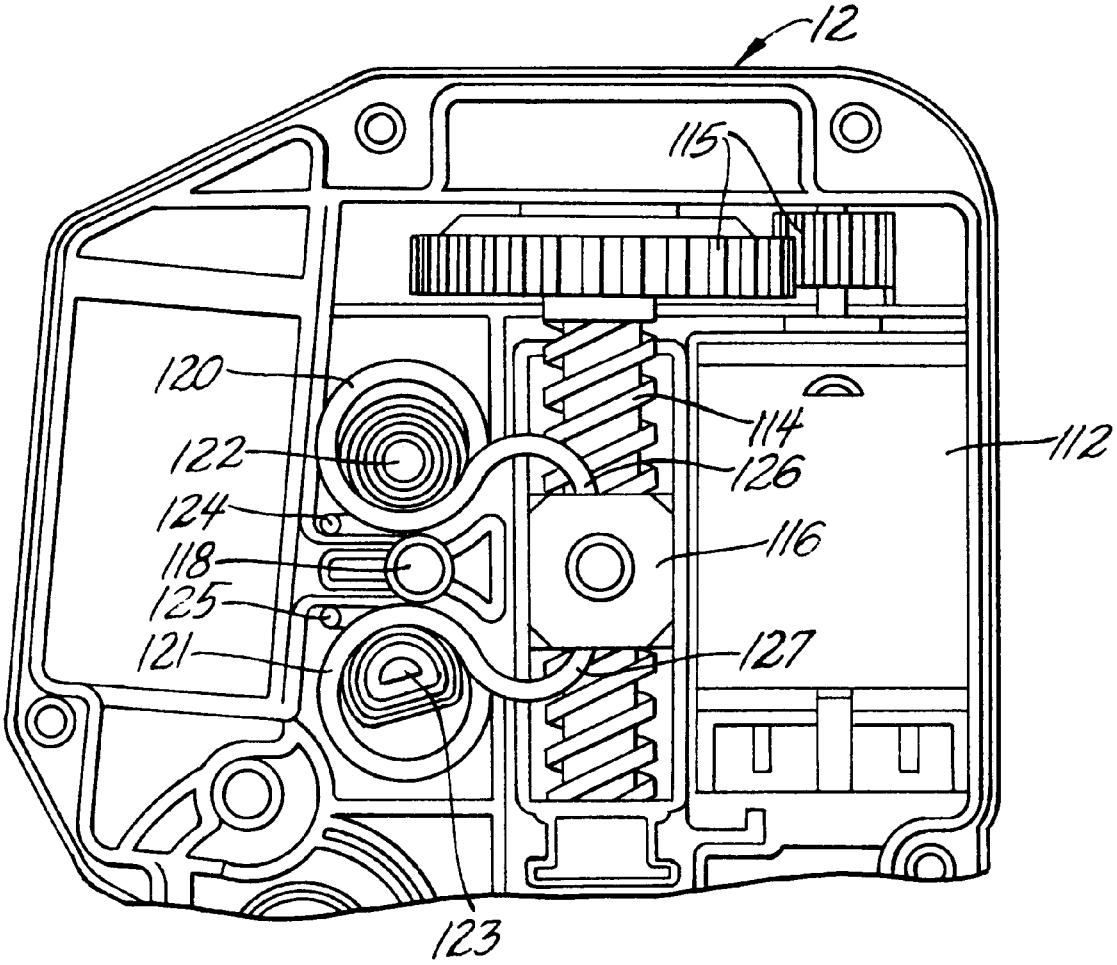
FIG. 5 is a partial front view of the plastic housing of the vehicle door latch of FIG. 1 equipped with a power lock and showing various parts of a centering device in a neutral position.
Figure 6:
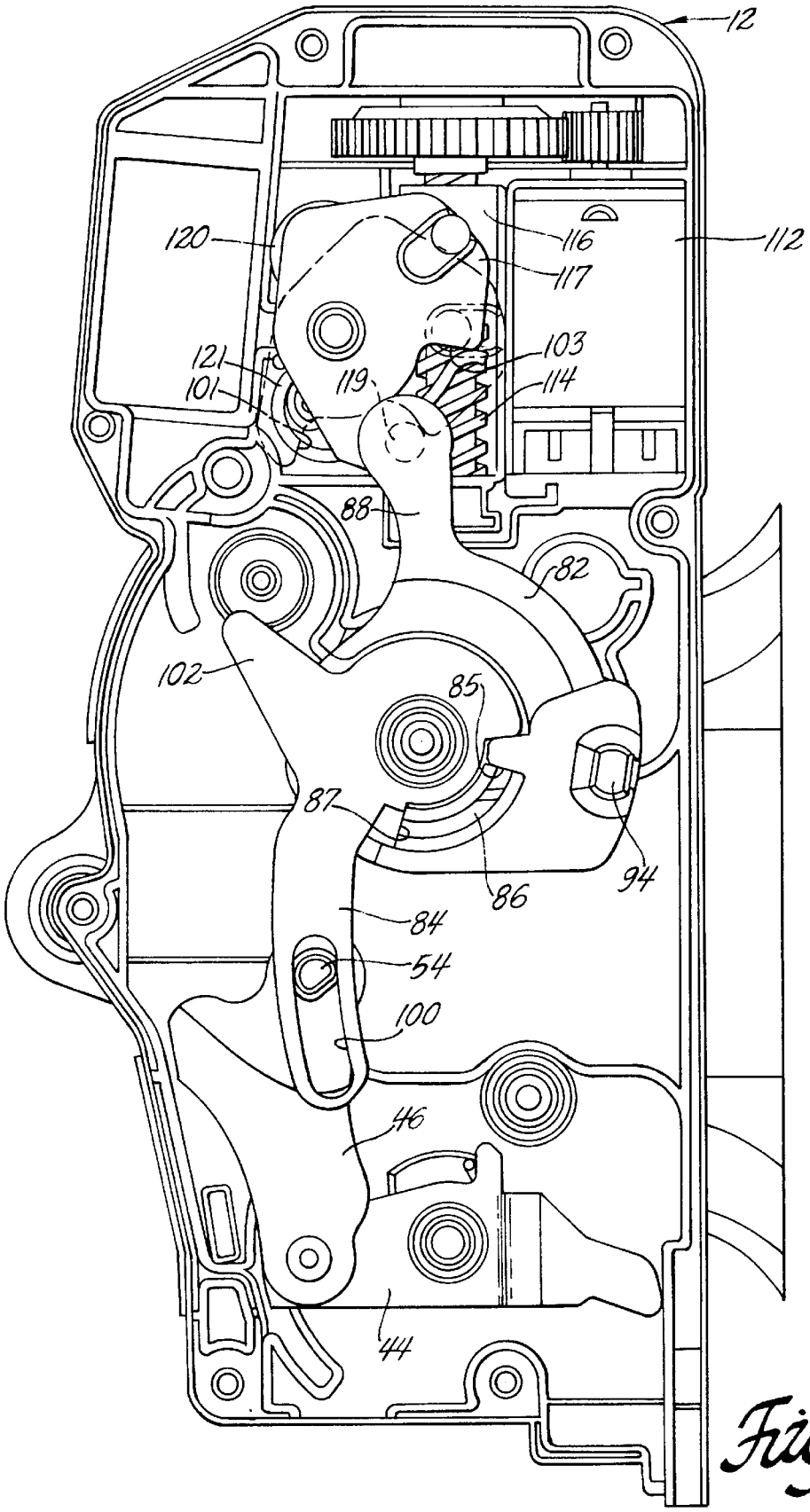
FIG. 6 is a front view of the plastic housing of the vehicle door latch of FIG. 1 equipped with a power lock and showing various parts in position when the door latch is latched and in the process of being unlocked.

As indicated above, door latch 10 may also be locked and unlocked by the power actuator assembly 92 shown in FIGS. 1, 5 and 6. Power actuator assembly 92 comprises a reversible electric actuator motor 112 that is located in chamber 64 and that drives an actuator gear screw 114 of a jackscrew that is located in adjacent chamber 63. Motor 112 drives screw 114 through a reduction gear set 115 located in an overhead compartment. Actuator gear screw 114 drives an actuator nut 116 of the jackscrew up or down depending upon the rotation of motor 112. Actuator nut 116 rotates bell crank lever 117 which is pivoted on stud 118 in chamber 62. Lower lock lever 82 includes a drive lug 119 at the outer side forward facing of radial arm 88. Drive lug 119 is disposed in a slot of bell crank lever 117 between shoulders 101 and 103 for driving lower lock lever 82 between the locked and unlocked positions.

Power actuator assembly 92 further includes a centering device that biases actuator nut 116 and bell crank lever 117 to a neutral position with respect to housing 12. As best shown in FIG. 5, the centering device comprises two coil springs 120 and 121 that are wound in opposite directions. Coil springs 120 and 121 are respectively located about two vertically spaced posts 122 and 123 that are located in chamber 62 of housing 12. Posts 122 and 123 are above and below pivot stud 118, respectively. Coil springs 120 and 121 each have an axial anchor tab 124, 125 at one end and a tangential reaction arms 126, 127 at the other end, respectively. Reaction arms 126, 127 engage upper and lower surfaces of actuator nut 116, respectively. Thus when actuator nut 116 is moved downwardly from the neutral position shown in FIG. 5, lower coil spring 121 is twisted clockwise storing energy to return actuator nut 116 back up to the neutral position. On the other hand, when actuator nut 116 is moved upwardly, upper coil spring 120 is twisted counterclockwise storing energy to return actuator nut 116 back down to the neutral position.

Assuming that door latch is latched and locked as shown in FIG. 4 door latch 10 is unlocked by power actuator assembly 92 in the following manner. A control switch is actuated that energizes electric motor 112 through a motor control circuit to drive pinion gear on the motor output shaft counterclockwise for a predetermined amount of time. The control switch can be manually operated or automatically operated responsive to vehicular drive or both. Such control switches and motor control circuits are well known in the art and need not be described in detail.

Suffice it to state that electric motor 92 is energized via a suitable motor control circuit to drive the pinion gear counterclockwise for a short period of time. The pinion gear drives the spur gear and the attached actuator gear screw 114 clockwise in a speed reducing, torque multiplying relationship. Actuator gear screw 114 drives actuator nut 116 up from the neutral position shown in FIGS. 4 and 5 to the raised position shown in FIG. 6 pivoting bell crank lever 117 counterclockwise to the unlock position also shown in FIG. 6.

Bell crank lever 117 rotates lower lock lever 82 clockwise from the locked position shown in FIG. 4 to the unlocked position shown in FIG. 6 via shoulder 101 and drive lug 119. Lower lock lever 82 drives upper lock lever 84 clockwise to the unlocked position shown in FIG. 6 via compression spring 86. Upper lock lever 84 drives intermittent lever 46 counterclockwise to the unlocked position shown in FIG. 6 via pin 54 and slot 100.

When electric motor 112 stops, upper coil spring 120 returns actuator nut 116 to the neutral position shown in phantom in FIG. 6 back driving motor 112 in the process. Shoulder 103 now engages drive lug 119 and the door latch 10 is in condition for a power locking operation as shown in FIG. 5.

Briefly, power locking is accomplished by energizing electric motor 112 in a reverse direction to drive actuator gear screw 114 counterclockwise. This drives actuator nut 116 down from the neutral position shown in phantom line in FIG. 6 to a lock position shown in FIG. 7. Lower lock lever 82 is now driven counterclockwise from the unlock position shown in FIG. 6 back to the lock position shown in FIG. 7. Lower lock lever 82 drives upper lock lever 84 counterclockwise to the unlock position shown in FIG. 7 via engaging portions 89 and 91 and upper lock lever 84 drives intermittent lever 46 clockwise to the locked position shown in FIG. 7 via pin 54 and slot 100. When locking is completed lower coil spring 121 returns actuator nut 116 to the neutral position shown in phantom where shoulder 101 engages drive lug 119 for an unlocking operation.

Door latch 10 may be locked and unlocked manually without effecting the power lock assembly 92 because of the wide gap between shoulders 101 and 103. The wide gap allows manipulation of lower lock lever 82 between locked and unlocked positions without imparting any movement to bell crank lever 117 and actuator nut 116. In fact, the gap is wider than tab 119 by a predetermined amount so that manual unlocking positions drive lug 119 against shoulder 101 for a subsequent power locking operation while manual locking positions drive lug 119 against shoulder 103 for a subsequent power unlocking operation.

As indicated above, the power lock assembly 92 can be used in a door latch having a lock lever of unitary construction. However, the composite lock lever 56 provides an anti-jamming feature that is particularly advantageous in a door latch that has a power operated lock mechanism.

Figure 8:
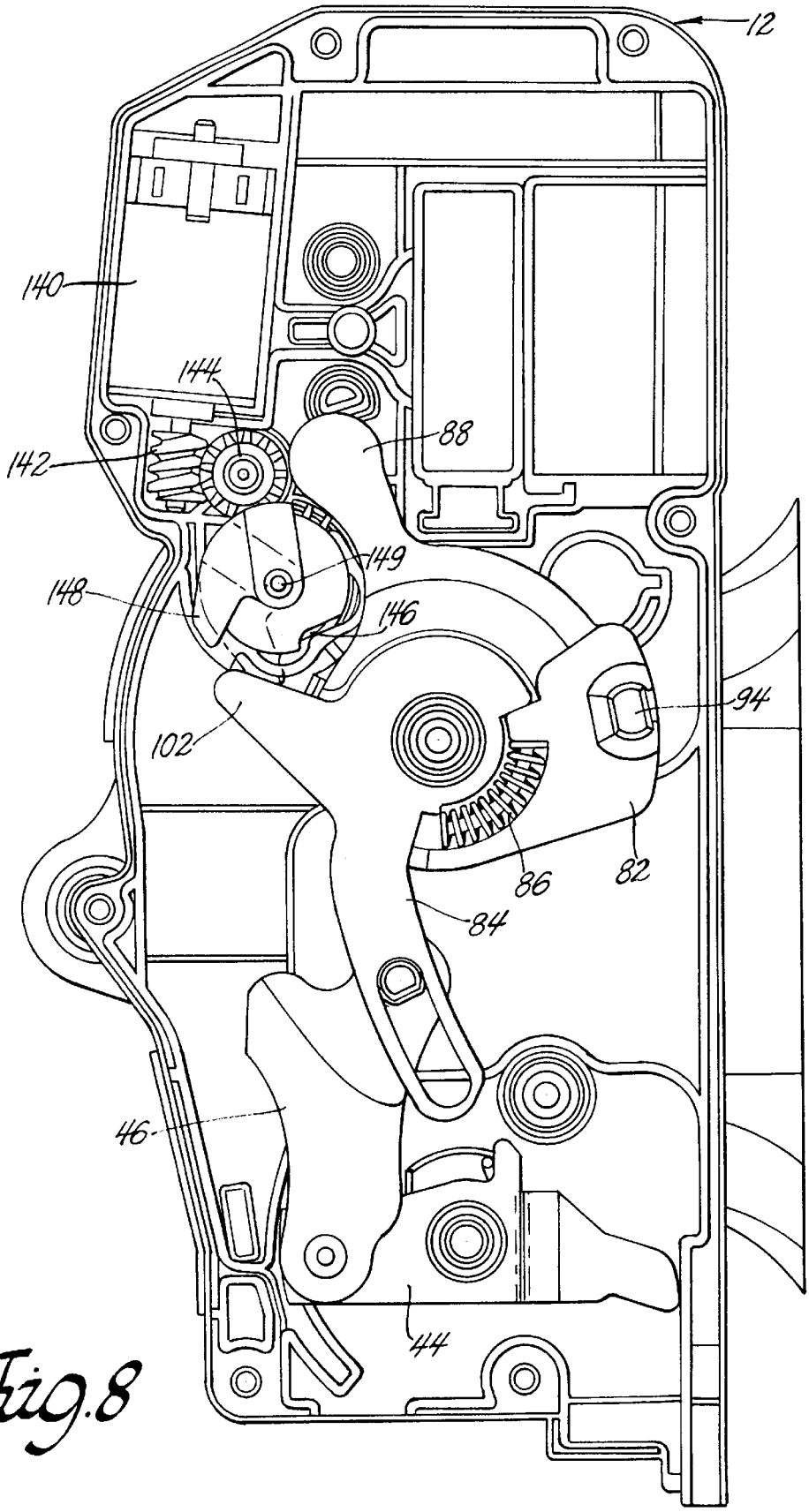
FIG. 8 is a front view of the plastic housing of the door latch of FIG. 1 equipped with a double lock assembly showing various parts in position when the door latch is latched, and locked with the double lock disengaged.
Figure 9:
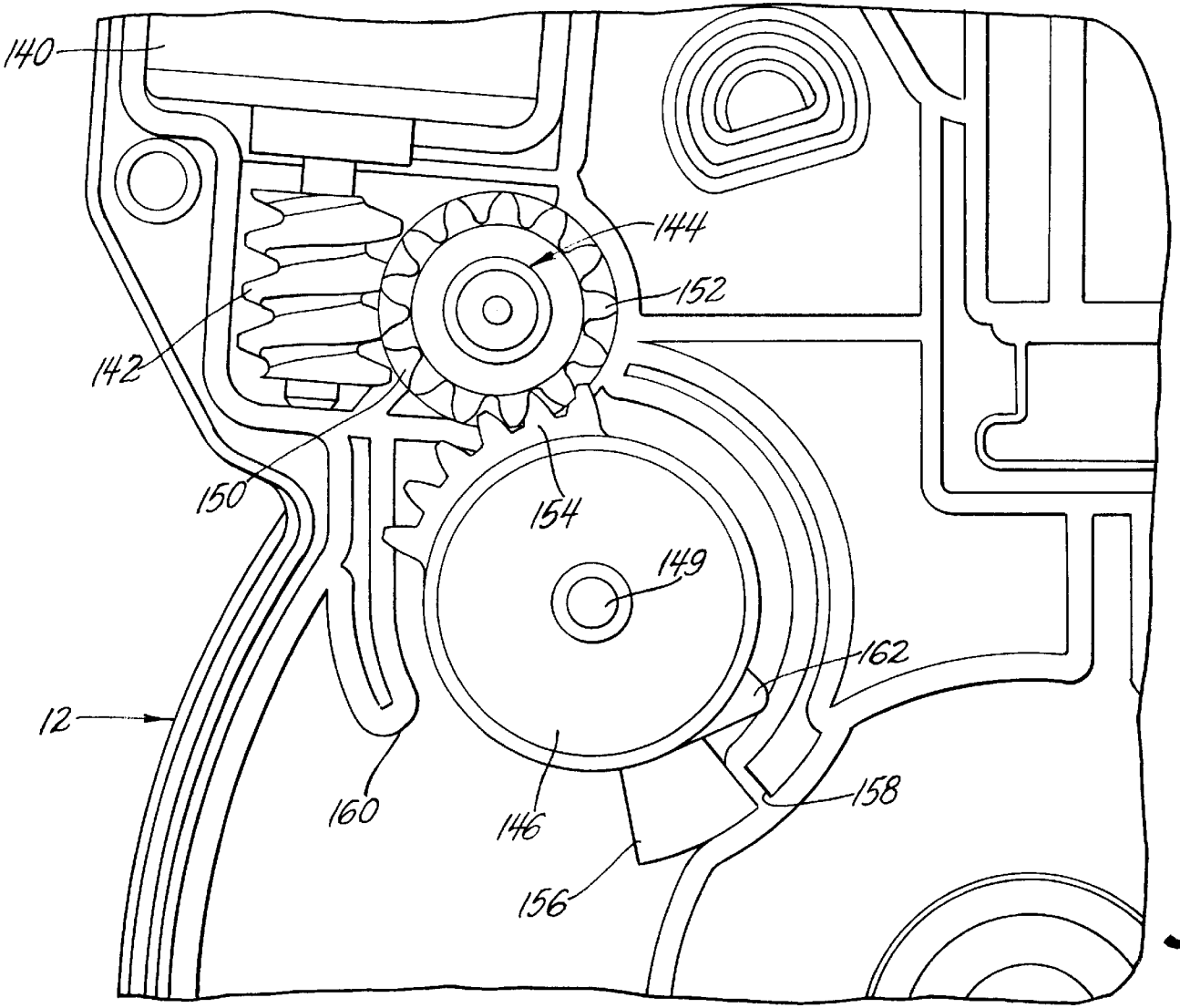
FIG. 9 is a partial front view of the door latch of FIG. 1 showing the parts of the double lock assembly in position when the door latch is latched, locked and double locked with the double lock block removed to show internal detail.

Double lock assembly 104 comprises a reversible electric motor 140 that is disposed in chamber 61 and that drives a worm gear 142; a compound gear 144 having end trunnions 145 journalled in housing 12 and front cover 16 respectively; a cam drive 146 and a double lock Block-out 148 both of which rotate on a post 149 of housing 12 as best shown in FIGS. 1 and 8. Worm gear 142 drives a lower helical gear 150 of compound gear 144; an upper spur gear 152 of which drives a sector gear 154 of gear cam drive 146 as best shown in FIGS. 1 and 9. Gear cam drive 146 has a lower tab 156 that is disposed between circumferentially spaced shoulders 158, 160 of housing 12 as best shown in FIG. 9. Tab 156 limits rotation of gear cam drive 146 between a double locked position shown in FIG. 9 where tab 156 engages shoulder 158 and an unlocked or by-pass position shown in FIG. 8 where tab 156 is stopped by shoulder 160 via an intervening leg of the double lock block-out 148 as explained below. Gear cam drive 146 also includes a drive ramp 162 that cooperates with double lock block-out 148 as explained below. Block-out 148 is removed in FIG. 8 to show details.

Figure 10:
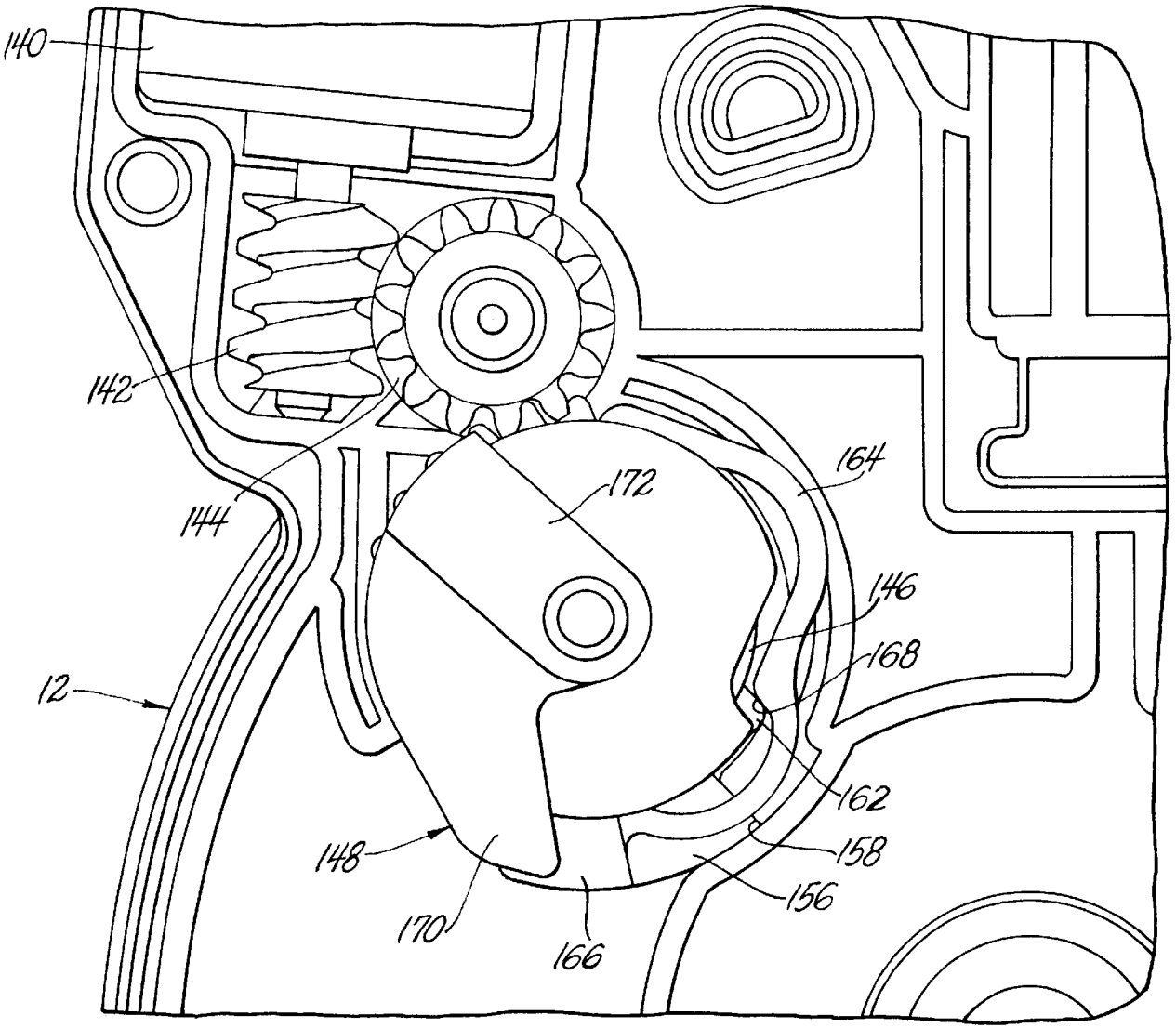
FIG. 10 is a partial front view of the door latch of FIG. 1 showing the parts of a double lock assembly in position when the door latch is latched, locked and double locked.

Referring now to FIG. 9, double lock block-out 148 is supported on gear cam drive 146 and rotates on the upper pin portion of post 149. Block out 148 has a partial skirt or sidewall 164 that has a thick leg 166 at one end. Leg 166 extends below skirt 164 and abuts tab 156 when drive ramp 162 engages an internal shoulder 168 of skirt 164 as best shown in FIG. 10.

The top of block-out 148 includes a tangential block-out ear 170 and a radial boss 172 that rises above the block-out ear. Block-out ear 170 cooperates with ear 102 (FIG. 8) of upper lock lever 84 to double lock door latch 10. Radial boss 172 cooperates with radial ear 109 of double lock back drive lever 105 to override the double lock in the event of a power failure as explained below in connection with FIGS. 11 and 12.

Door latch 10 is double locked as follows. First door latch 10 is locked as described above which rotates both lower and upper lock levers 82 and 84 to the locked position shown in FIG. 8. This moves the ear 102 of upper lock lever 84 clockwise from the unlocked position shown in FIG. 6 to the locked position shown in FIG. 8. Motor 140 which is usually controlled by a key lock cylinder or a key fob is then energized to rotate gear cam drive 146 clockwise via gears 140, 150, 152 and 154 from the unlocked or bypass-position shown in FIG. 8 to the double lock position shown in FIGS. 9 and 10. Block-out 148 rotates clockwise with gear cam drive 146 from the by-pass position shown in FIG. 8 to the double lock position shown in phantom in FIG. 8 and in FIGS. 10 and 11 due to the engagement of drive ramp 162 with internal shoulder 168. Block-out ear 170 thus rotates from the by-pass position shown in FIG. 8 to the double lock or block-out position shown in phantom in FIG. 8 and in FIG. 11 where block-out ear 170 is in the path of movement of ear 102 of upper locking lever 84 as it attempts to move clockwise from the locked position of FIG. 8 to the unlocked position of FIG. 6. The presence of block-out ear 170 thus prevents clockwise rotation of upper lock lever 84 (and the concurrent counterclockwise rotation intermittent lever 46) back to the unlocked position shown in FIG. 6.

When the double lock is engaged, door latch 10 cannot be unlocked by inside lock lever 96 because clockwise rotation of inside lock lever 96 to the unlocked position merely rotates lower lock lever 82 clockwise back to the unlocked position as shown in FIG. 6. However, upper lock lever 84 being blocked by the double lock Block-out 148 stays in the locked position with the clockwise rotation of lower lock lever 82 storing energy in compression spring 86 for subsequent unlocking upon disengagement of the double lock block-out 148.

The optional double lock assembly 104 prevents unauthorized persons from entering a double locked vehicle by using the sill button or other inside lock operator to unlock the vehicle door and then unlatching the door using the outside door handle.

The double lock can be disengaged in two ways. One way is to reverse electric motor 140 so that block-out ear 170 is rotated clockwise from the double lock position shown in FIG. 10 back to the by-pass or disengaged position shown in solid line in FIG. 8. This unblocks ear 102 of upper lock lever 84 and allows upper lock lever 84 to rotate clockwise back to the unlocked position shown in FIG. 6 under the action of compression spring 86 when door latch 10 is unlocked. In this regard it should be noted that the unlocking operation can be undertaken before or after double lock 104 is disengaged. If the unlocking operation is undertaken before double lock 104 is disengaged, lower lock lever 82 is moved to the unlocked position cocking the lock mechanism. Upper lock lever 84 and the rest of the locking mechanism is then moved to the unlocked position by spring 86 when double lock 104 is disengaged.

If double lock 104 is disengaged first, the unlocking operation proceeds in a conventional manner as in the case of a door latch that is not equipped with a double lock.

Figure 11:
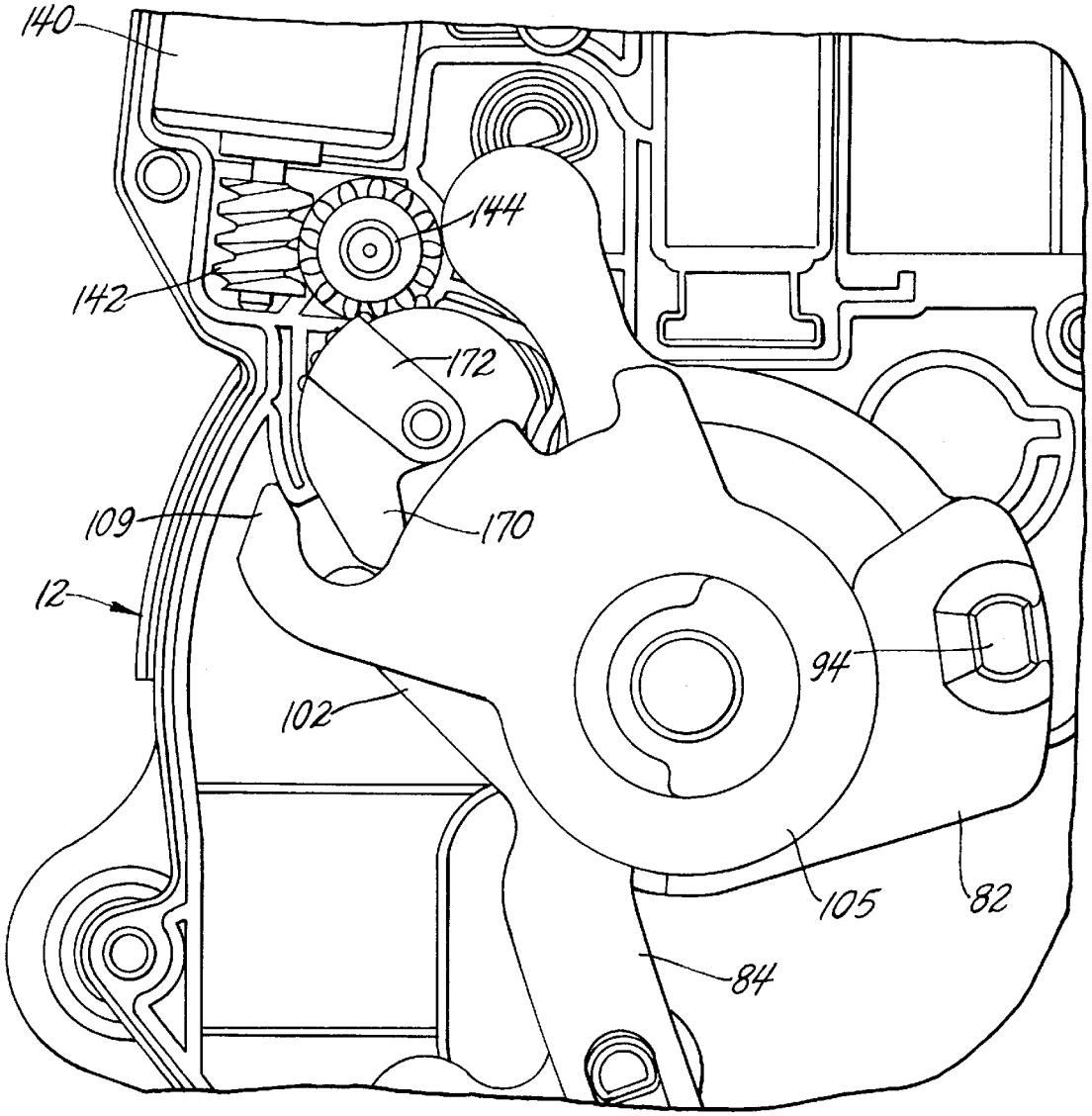
FIGS. 11 and 12 are partial front views of the door latch of FIG. 1 showing the double lock assembly and the double lock unblocking lever in detail.
Figure 12:
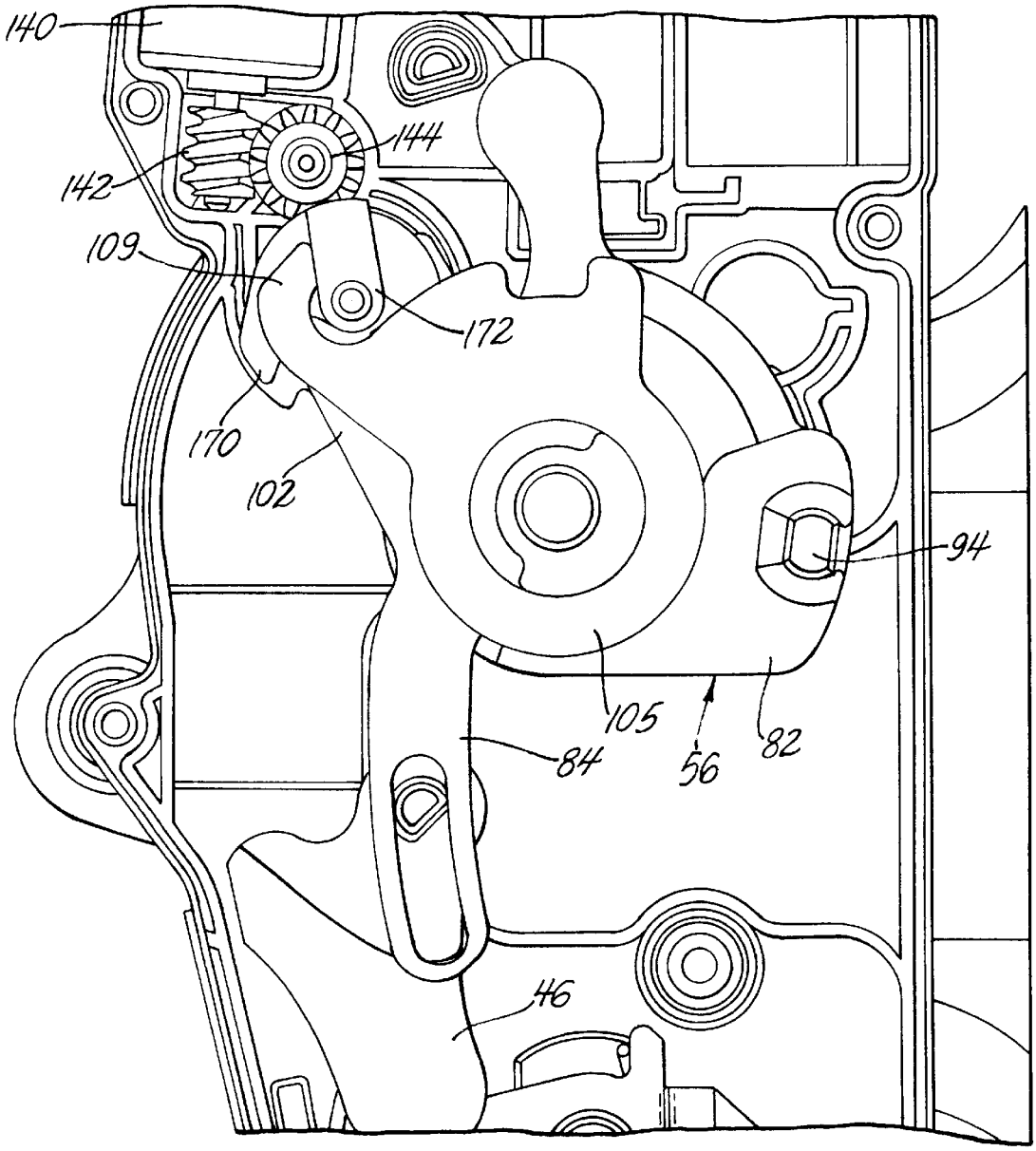

The second way to disengage double lock 104 is by a key entry by using a key lock cylinder (not shown) to rotate key cylinder lever 106 (FIG. 6) clockwise so that double lock back drive lever 105 rotates clockwise from the locked position shown in FIG. 11 to the unlocked position shown in FIG. 12. As key cylinder lever 106 rotates clockwise to the unlocked position, ear 109 of double lock back drive lever 105 rotates clockwise along with lever 106 and rotates double lock block-out 148 clockwise via radial boss 172 back to the by-pass position shown in FIGS. 8 and 12. The optional slot near ear 109 may also be used to operate an optional signal switch (not shown) to operate an instrument panel light indicating the condition of the double lock.

Electric motor 140 cannot be back-driven and the gear cam drive 146 is held steadfast in the double lock position when double lock block-out 148 is rotated back to the by-pass position. However, skirt 164 is resilient enough so that internal lock shoulder 168 snaps past drive ramp 162 allowing double lock block-out 148 to rotate clockwise with respect to gear cam drive 146 and back to the disengaged or by-pass position shown in FIGS. 8 and 12.

Figure 7:
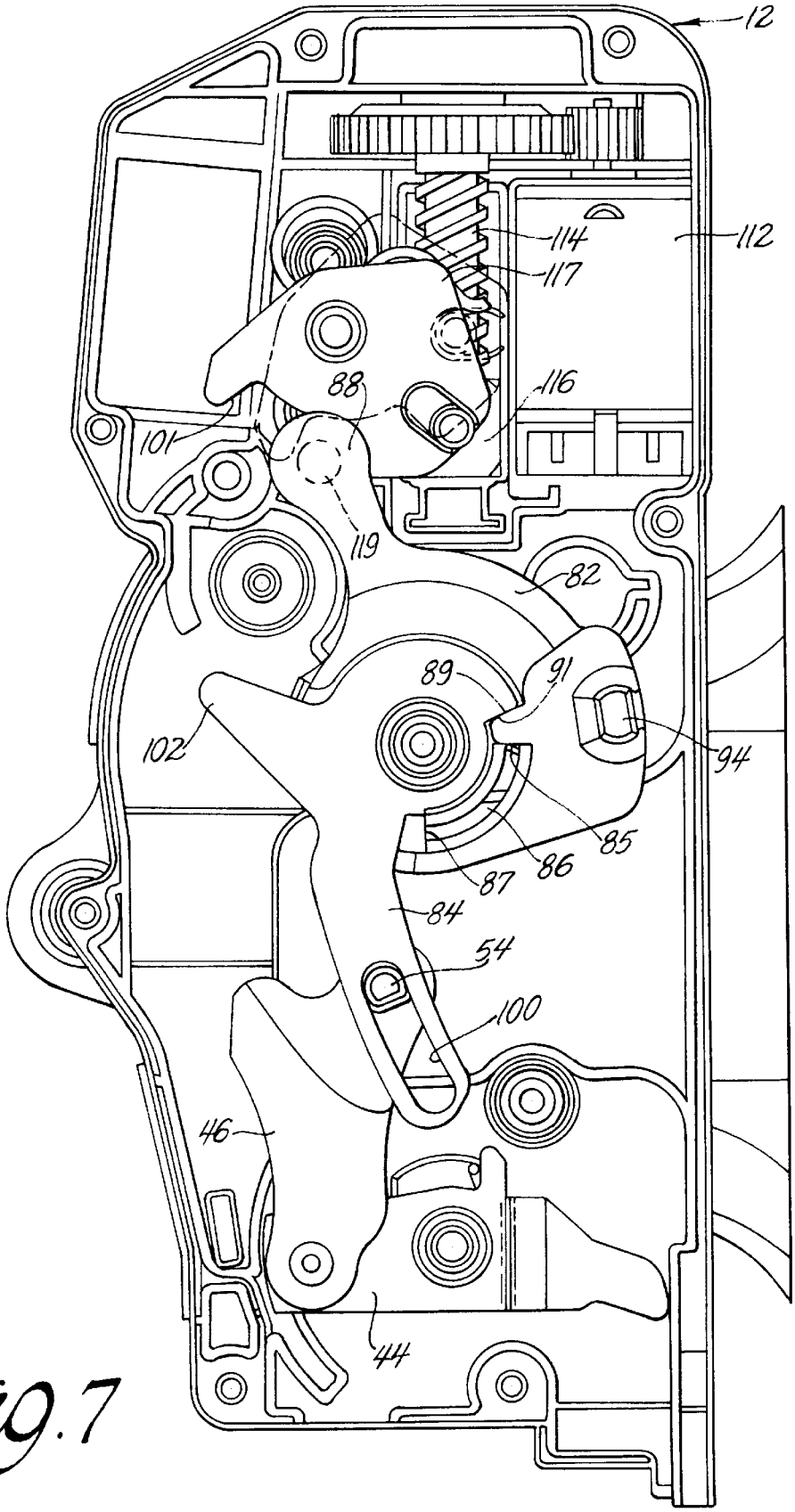
FIG. 7 is a front view of the plastic housing of vehicle door latch of FIG. 1 equipped with a power lock and showing various parts in position when the door latch is latched and in the process of being locked.

This clockwise rotation of double lock block-out 148 also unblocks ear 102 of upper lock lever 84 and allows upper lock lever 84 to rotate clockwise back to the unlocked position shown in FIG. 7 under the action of compression spring 86 when door latch 10 is unlocked before the double lock 104 is disengaged. If the double lock 104 is disengaged first, door latch 10 is unlocked in a conventional manner to move upper and lower lock levers 82 and 84 and intermittent lever 56 from the locked positions shown in FIG. 11 back to the unlocked positions shown in FIG. 12.

This second way permits authorized key entry (or exit) when the door latch 10 is double locked and also provides entry or exit in the event of power failure.

When this second disengagement method is used, the double lock assembly 104 is restored by reversing electric motor 140 which rotates gear cam drive 146 clockwise with respect to double lock block-out 148 and back to the by-pass or disengaged position. As cam drive 146 returns to the disengaged position drive ramp 162 snaps into place behind internal shoulder 168. Double lock assembly 104 is now ready for a power engagement.

Many modifications and variations of the present invention in light of the above teachings may be made. It is, therefore, to be understood that, within the scope of the appended claims, the invention may be practiced otherwise than as specifically described.

What is claimed is:

1. A vehicle door latch having a forkbolt that moves between a latched position and an unlatched position, a detent for holding the forkbolt in the latched position, a release mechanism for moving the detent to release the forkbolt and a lock mechanism for disabling the release mechanism comprising:

an intermittent lever for moving the detent to release the forkbolt forming part of the release mechanism and part of the lock mechanism, the intermittent lever moving from a latch position to an unlatch position for moving the detent to release the forkbolt, a composite lock lever forming part of the lock mechanism, the composite lock lever having an upper lock lever and a lower lock lever that pivot on a stud and a spring for storing energy when the lower lock lever pivots with respect to the upper lock lever, the upper lock lever moving back and forth between an unlocked position and a locked position to move the intermittent lever back and forth between an unlock position where the intermittent lever drives the detent to release the forkbolt and a lock position where the intermittent lever moves from the latch position to the unlatch position without driving the detent, an inside lock lever forming part of the lock mechanism for operating the lower lock lever, and a double lock assembly for disabling the lock mechanism so that the door latch cannot be unlocked by the inside lock lever, the double lock assembly having a rotary double lock block-out that rotates back and forth between a by-pass position and a double lock position where the double lock block-out blocks movement of the upper lock lever from the locked position to the unlocked position so that the inside lock lever pivots the lower lock lever with respect to the upper lock lever whereby the vehicle door latch cannot be unlocked by the inside lock lever.

2. A vehicle door latch having a forkbolt that moves between a latched position and an unlatched position, a detent for holding the forkbolt in the latched position, a release mechanism for moving the detent to release the forkbolt and a lock mechanism for disabling the release mechanism comprising:

an intermittent lever for moving the detent to release the forkbolt forming part of the release mechanism- and p art of the lock mechanism, the intermittent lever moving from a latch position to an unlatch position for moving the detent to release the forkbolt, a lock lever forming part of the lock mechanism, the lock lever moving back and forth between an unlocked position and a locked position to move the intermittent lever back and forth between an unlock position where the intermittent lever drives the detent to release the forkbolt and a,lock position where the intermittent lever moves from the latch position to the unlatch position without driving the detent, an inside lock lever forming part of the lock mechanism for operating the lock lever, and a double lock assembly for disabling the lock mechanism so that the door latch cannot be unlocked by the inside lock lever, the double lock assembly having a rotary double lock block-out that rotates back and forth between a by-pass position and a double lock position where the double lock block-out blocks movement of the lock lever from the locked position to the unlocked position, the double lock assembly including a rotary cam drive that rotates the rotary double lock block-out back and forth between the bypass position and the double lock position.

3. A vehicle door latch having a forkbolt that moves between a latched position and an unlatched position, a detent for holding the forkbolt in the latched position, a release mechanism for moving the detent to release the forkbolt and a lock mechanism for disabling the release mechanism comprising:

an intermittent lever for moving the detent to release the forkbolt forming part of the release mechanism and part of the lock mechanism, the intermittent lever moving from a latch position to an unlatch position for moving the detent to release the forkbolt, lock lever forming part of the lock mechanism, the lock lever moving back and forth between an unlocked position and a locked position to move the intermittent lever back and forth between an unlock position where the intermittent lever drives the detent to release the forkbolt and a lock position where the intermittent lever moves from the latch position to the unlatch position without driving the detent, an inside lock lever forming part of the lock mechanism for operating the lock lever, a double lock assembly for disabling the lock mechanism so that the door latch cannot be unlocked by the inside lock lever, the double lock assembly having a rotary double lock block-out that rotates back and forth between a by-pass position and a double lock position where the double lock block-out blocks movement of the lock lever from the locked position to the unlocked position, the double lock assembly including a rotary cam drive that rotates the rotary double lock block-out back and forth between the by-pass position and the double lock position, and the rotary double lock block-out and the rotary cam drive rotating on a common axis and the double lock block-out being supported on the rotary cam drive.

4. The vehicle door latch as defined in claim 3 wherein the rotary cam drive has a drive ramp that engages a shoulder of the double lock block-out to drive the double lock block-out from the by-pass position to the double lock position.

5. The vehicle door lock as defined in claim 4, wherein the double lock assembly includes an electric motor that drives the rotary cam drive and a rotatable mechanical override lever that engages the double lock block-out and rotates to move the double block lock out from the double lock position to the by-pass position, the shoulder being on a resilient portion of the double lock block-out so that the shoulder snaps past the drive ramp when the mechanical override lever moves the double lock block-out from the double lock position to the by-pass position.

6. A vehicle door latch having a forkbolt that moves between a latched position and an unlatched position, a detent for holding the forkbolt in the latched position, a release mechanism for moving the detent to release the forkbolt and a lock mechanism for disabling the release mechanism comprising:

an intermittent lever for moving the detent to release the forkbolt forming part of the release mechanism and part of the lock mechanism, the intermittent lever moving from a latch position to an unlatch position for moving the detent to release the forkbolt, a composite lock lever forming part of the lock mechanism and including a lower lock lever and an upper lock lever that pivot on a stud and a spring for storing energy when the lower lock lever pivots with respect to the upper lock lever, the upper lock lever moving back and forth in a path between an unlock lock position and a lock position to move the intermittent lever back and forth between an unlock position where the intermittent lever drives the detent to release the forkbolt and a lock position where the intermittent lever moves from the latch position to the unlatch position without driving the detent, an inside lock lever forming part of the lock mechanism for operating the lower lock lever, and a double lock assembly for disabling the lock mechanism so that the door latch cannot be unlocked by the inside lock lever, the double lock assembly having an electric motor that drives a rotary cam drive back and forth between a by-pass position and a block-out position, a rotary double lock block-out that rotates back and forth between a bypass position and a double lock position where the double lock block-out is in the path and blocks movement of the upper lock lever from the locked position to the unlocked position, the rotary cam drive having a drive ramp that engages a shoulder of the double lock block-out to drive the double lock block-out from the by-pass position to the double lock position, and the double lock assembly having a rotatable mechanical override lever that engages the double lock block-out to rotate the double block-lock out from the double lock position to the by-pass position and out of the path of the upper lock lever, the shoulder being on a resilient skirt of the double lock block-out so that the shoulder snaps past the drive ramp when the mechanical override lever moves the double lock block-out from the double lock position to the by-pass position.

7. The vehicle door latch as defined in claim 6 wherein the rotary cam drive and the double lock block-out rotate about a common axis with the double lock block-out being supported by the rotary cam drive, the double lock block-out has a tangential ear that protrudes into the path and blocks movement of the upper lock lever from the locked position to the unlocked position, the rotatable mechanical override lever engages a radial boss of the double lock block-out to rotate the double block lock out from the double lock position to the by-pass position and out of the path of the upper lock lever and the shoulder is part of a resilient skirt of the double lock block-out so that the shoulder snaps past the drive ramp when the mechanical override lever moves the double lock block-out from the double lock position to the by-pass position.

8. A vehicle door latch having a forkbolt that moves between a latched position and an unlatched position, a detent for holding the forkbolt in the latched position, a release mechanism for moving the detent to release the forkbolt and a lock mechanism that includes a lock lever that moves back and forth between an unlock position where the release mechanism is operative and a lock position where the release mechanism is disabled, an inside lock lever forming part of the lock mechanism for operating the lower lock lever, and a double lock assembly for disabling the lock mechanism so that the door latch cannot be unlocked by the inside lock lever, the double lock assembly comprising:

an electric motor that drives a rotary cam drive back and forth between a by-pass position and a block-out position, a rotary double lock block-out that is supported on the rotary cam drive and that rotates back and forth between a by-pass position and a double lock position about a common axis with the rotary cam drive, the double lock block-out permitting movement of the lock lever back and forth between the unlock position and the lock position in the by-pass position, and the double lock block-out having a tangential ear that blocks movement of the lock lever from the locked position to the unlocked position when the double lock block-out is in the double lock position, the rotary cam drive having a drive ramp that engages a shoulder of the double lock block-out to drive the double lock block-out from the by-pass position to the double lock position, and a rotatable mechanical override lever that engages a radial boss of the double lock block-out to rotate the double lock block-out from the double lock position to the by-pass position, the shoulder being on a resilient skirt of the double lock block-out so that the shoulder snaps past the drive ramp when the mechanical override lever moves the double lock block-out from the double lock position to the by-pass position to permit unlocking of the door latch when the electric motor is inoperative.

* * * * *